United States Patent [19]

Henze

[11] 4,410,803

[45] Oct. 18, 1983

[54] THREAD-MONITORING DEVICE FOR TEXTILE MACHINES

[75] Inventor: Bernhard Henze, Emmerthal, Fed. Rep. of Germany

[73] Assignee: Seil Textilmaschinenzubehor GmbH, Emmerthal, Fed. Rep. of Germany

[21] Appl. No.: 313,277

[22] Filed: Oct. 21, 1981

[30] Foreign Application Priority Data

Oct. 23, 1980 [DE] Fed. Rep. of Germany ..... 3039954

[51] Int. Cl.[3] ..... G01N 21/86

[52] U.S. Cl. ..... 250/561; 112/273; 139/370.2

[58] Field of Search ..... 250/561; 28/187; 57/81; 66/161, 163; 139/273 A, 370.2; 112/273, 278

[56] References Cited

U.S. PATENT DOCUMENTS 3,565,121 2/1971 Svaty et al. ..... 139/370.2

*Primary Examiner*—David C. Nelms
*Assistant Examiner*—Darwin R. Hostetter
*Attorney, Agent, or Firm*—Allison C. Collard; Thomas M. Galgano

[57] ABSTRACT

A thread-monitoring device for monitoring threads being fed to a textile machine, comprising for each pair of threads to be monitored, a two-arm lever pivotally mounted in a pendulum-like manner and provided at the free ends of its arms with respective thread guides. A pair of threads to be monitored is led down past a corresponding two-arm lever such that with the threads engaged in respective ones of the lever's thread guides the threads exert forces on the lever which normally balance out and leave the lever in a central position. Upon this balance of forces being upset, for example, due to thread breakage or unequal thread tensions, the lever is arranged to be displaced from its central position, this displacement being detected by suitable sensor means.

3 Claims, 5 Drawing Figures

THREAD-MONITORING DEVICE FOR TEXTILE MACHINES

The present invention relates to a thread-monitoring device for a textile machine and, in particular, but not exclusively, to a thread-monitoring device for a tufting machine.

Thread-monitoring devices are known of the type wherein a plurality of threads running side by side in a row are monitored with the aid of a light beam which extends transversely of the threads and parallel to the plane defined by the thread row, to stimulate a light sensor of the device.

In one form of thread-monitoring device of this type (see, for example, German Utility Model No. 1723393), the change of state of a thread upon breakage is used to bring about at least partial interruption of the stimulation of the light sensor by arranging for the broken thread to enter into the light beam.

In thread-monitoring devices of this latter form auxiliary means are usually provided to ensure that the broken thread will enter the light beam; thus, the broken thread may be guided through the beam by means of a driven brush of a strong forced draught. Despite the provision of such guiding means, it is however, still possible that the thread-monitoring device may fail to register breakage of a thread because the latter is either too thin or it passes through the light beam too quickly. To minimise the risk of the thread-monitoring device failing to respond to a thread breakage, the device has to be made sensitive to very small changes in the stimulation of the light sensor. However, if this is done, the likelihood is increased of the monitoring device responding to interruptions of the light beam caused by dust and fluff present in the working environment of the textile machine; this, of course, is undesirable as it means that the textile machine will be continually switched off unnecessarily.

Another form of thread-monitoring device of the aforesaid type is shown in German Utility Model No. 76016, the monitoring device disclosed therein including a plurality of one-arm levers each engaged by a respective one of the threads to be monitored. Each lever and its associated thread forms a balanced system in which the tension forces in the thread are in equilibrium with the weight of the lever; upon breakage of the thread, the equilibrium of the system is disturbed resulting in the lever swinging into the light beam and interrupting stimulation of the light-sensor of the monitoring device. As a consequence, the associated textile machine is switched off. One disadvantage of this thread-monitoring device is that threads which are too tight or too slack cannot be monitored. In addition, such a device requires a considerable amount of space because all the levers lie side by side in a single row.

It is an object of the present invention to provide a thread-monitoring device which utilises a rocking lever arrangement in such a way that not only thread breakages, but also changes in tension of the thread, are detected and result in the associated textile machine being switched off.

Accordingly, the present invention provides a thread-monitoring device for a textile machine, the device including, for each pair of threads to be monitored:

a two-arm lever pivotally mounted in a pendulumlike manner and provided at the free ends of its arms with respective thread guides, and thread guiding means arranged to guide the pair of threads to be monitored past the lever such that with the threads engaged with respective ones of the lever's thread guides, the threads exert forces upon the lever which normally balance each other out to leave the lever in a central position, imbalance of said forces being arranged to cause the lever to move from its central position, said device further including sensor means for detecting displacement of a said lever from its central position.

Preferably, the monitoring device comprises a plurality of levers arranged side-by-side in a row with a common axis of pivoting, said sensor means including light-sensitive detector means disposed at one end of said row of levers, and light-beam generating means disposed at the opposite end of said row and arranged to direct at least one beam of light along the row of levers such that with all the levers in their central position, the said at least one beam illuminates the detector means, whereas with one or more levers displaced from their central positions, the illumination of the detector means is at least partially interrupted.

In one embodiment, the light beam generating means generates two beams which pass down opposite sides of the lever row, a lever displaced from its central position being arranged to interrupt one or other of the beams in dependence on its direction of displacement.

Displacement of a lever from its central position may result either from a break in one of the threads associated with the lever or by the tension in one or other of the threads becoming too great or too small relative to the tension in the other thread. The ability of the thread-monitoring device to detect abnormal thread tensions, enables the associated textile machine to be switched off before a fault is actually made in the material being manufactured by the machine, this not having previously been possible. Switching off of the textile machine in the presence of abnormal tensions but before a thread breakage occurs, is also advantageous inasmuch as after a thread breakage, it is necessary to pick up and rejoin threads.

The monitoring device of the present invention also gives rise to an improved guiding of the threads to the textile machine. This results from the fact that due to the arrangement of the rocking levers, the threads of, for example, BCF-yarn (continuous yarn) and also of artificial fibre, are guided through the monitoring device along two separate paths. Thus, uneven numbered threads 1, 3, 5, 7 etc. pass along one path taking them through the thread guides carried by one arm of the levers, whilst the even numbered threads 2,4,6, 8 etc. are guided along different paths taking them through the thread guides of the other arm of the levers. As a result, the risk of capillary breaks in continuous yarn or protruding artificial fibres in spun yarn causing two adjacent threads to become entangled is considerably reduced.

In previously known thread-monitoring devices, the thickness and tension of the threads being monitored is of great importance. Furthermore, the strength of the threads also has to be taken into account. However, with the device of the present invention, these parameters no longer have to be taken into account since the two threads associated with each two-arm lever act as monitoring standards for each other.

The exact monitoring of the thread tension made possible by the present monitoring device inevitably ensures a better final product. The monitoring device is particularly suitable for use with tufting machines, being readily incorporated in such machines due to the clear run of threads available.

A thread-monitoring device embodying the present invention will now be particularly described, by way of example, with reference to the accompanying diagrammatic drawing, in which.

Figure 1:
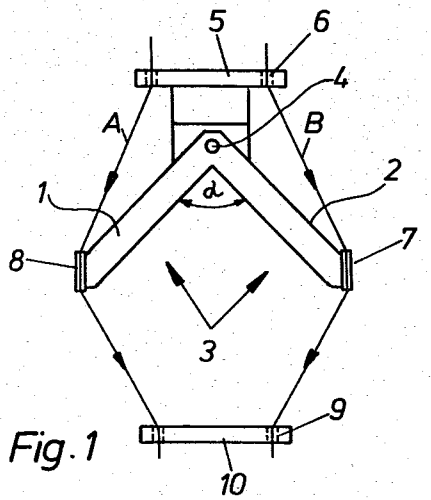
FIG. 1 shows a two-arm lever of the monitoring device, the lever being arranged to monitor one pair of threads and being shown in its normal central position in which the forces exerted by the threads on the lever balance each other out.

As shown in FIG. 1, the thread monitoring device comprises, for each pair of threads to be monitored, a lever 3 with two arms 1 and 2. The lever 3 is carried by a support arrangement 5 for pivotal movement about an axis 4 in the manner of a pendulum; where a plurality of levers 3 are provided, they are preferably pivotally mounted about a common axis 4.

The support arrangement 5 is provided with lateral guide openings 6 for the threads A and B which are to be monitored by the lever 3. Above the support arrangement 5 both threads run parallel to one another. Below the support arrangement 5 the threads are guided by engagement with guide bushes 7 and 8 provided at the free ends of the lever arms 1 and 2. From the bushes 7 and 8 both threads run towards one another and after passing through openings 9 of a lower guide bar 10 run once more parallel to one another and on into the textile machine associated with the thread monitoring device.

In the example shown, the two lever arms 1 and 2 are at an angle $\alpha$, the size of this angle being determined by the particular working requirements of the monitoring device and the associated textile machine.

Normally, with both threads A and B running at equal tensions, the lever 3 is subjected to equal and opposite forces by the threads with the result that the lever 3 3 remains in its central position as illustrated in FIG. 1.

As soon as the equilibrium of forces exerted on the lever by the threads is upset, for instance, by the thread A being subjected to too great a tension, (see FIG. 2) one of the arms, in this case the arm 1, will be forced inwards, whereby the other arm (arm 2) will swing outwards to interrupt a light beam (not shown), this beam being directed parallel to the axis 4 and such as to lie to the right (as viewed) of the lever 2 when the latter is in its central position. Suitable means (also not shown) are provided to switch off the textile machine upon the light beam being interrupted.

Figure 2:
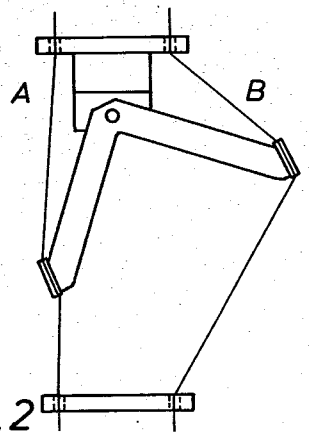
FIG. 2 shows the position assumed by the two-arm lever of FIG. 1 when thread A is running too tight.
Figure 3:
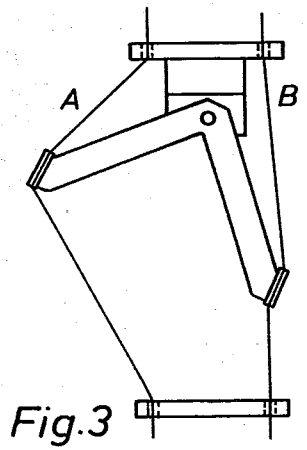
FIG. 3 shows the position assumed by the two-arm lever of FIG. 1 when thread B is running too tight.

In FIG. 3 the reverse situation to that of FIG. 2 is represented, with the thread B being under too great a tension and causing the lever arm 1 to swing outwards and interrupt a second light beam (not shown) which lies to the left of the lever 3.

Figure 4:
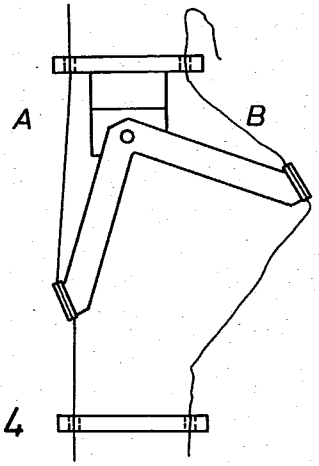
FIGS. 4 and 5 show the positions assumed by the FIG. 1 lever when a break occurs in thread A, B respectively.
Figure 5:
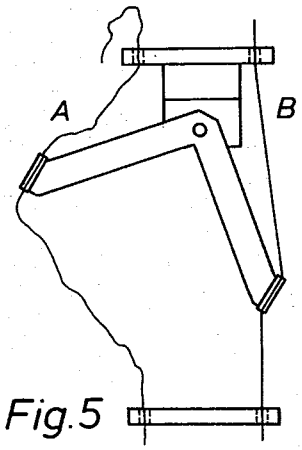

Should one of the threads break, for example thread B in FIG. 4 and thread A in FIG. 5, the lever 3 again swings outwards breaking through one or other of the light beams and thereby ensuring that the textile machine is switched off.

In the illustrated monitoring device, the threads of each pair being monitored serve as monitoring standards for each other in respect of defects such as thread breakages, slack threads or threads that are too tight. Because each lever monitors two threads, the illustrated monitoring device saves space as compared with the known single-arm lever row arrangement, since the number of levers, and thus the lever row length, is reduced by half.

Although in the described monitoring device, light beams have been used to detect displacement of the two-arm lever 3 from its central position, any other suitable sensor means can be used, if desired.

I claim:

1. A thread-monitoring device for a textile machine, the device including, for each pair of threads to be monitored:

a two-arm lever pivotally mounted in a pendulum-like manner and provided at the free ends of its arms with respective thread guides, and thread guiding means arranged to guide the pair of threads to be monitored past the lever such that with the threads engaged with respective ones of the lever's thread guides, the threads exert forces upon the lever which normally balance each other out to leave the lever in a central position, imbalance of said forces being arranged to cause the lever to move from its central position, said device further including sensor means for detecting displacement of a said lever from its central position.

2. A thread-monitoring device according to claim 1, wherein a plurality of levers are arranged side-by-side in a row with a common axis of pivoting, said sensor means including light-sensitive detector means disposed at one end of said row of levers, and light-beam generating means disposed at the opposite end of said row and arranged to direct at least one beam of light along the row of levers such that with all the levers in their central positions, the said at least one beam illuminates the detector means, whereas with one or more levers displaced from their central positions, the illumination of the detector means is at least partially interrupted.

3. A thread-monitoring device for a textile machine, the device being of the type wherein a plurality of threads running side-by-side in a row are monitored with the aid of a light beam which extends transversely of the threads and parallel to the plane defined by the thread row, to stimulate a light sensor of the device; the device including a plurality of two-arm levers each of which is mounted in a pendulum-like manner and is provided at the free ends of its arms with guide elements for guiding two threads to be monitored.

* * * * *